US007357966B2

(12) United States Patent
Dipple et al.

(10) Patent No.: US 7,357,966 B2
(45) Date of Patent: Apr. 15, 2008

(54) SYNTHETIC TURF SYSTEM AND METHOD

(75) Inventors: Ted Dipple, Andover, MA (US); Joe DiGeronimo, Sturbridge, MA (US)

(73) Assignee: New England Soccer School, LLC, Andover, MA (US)

( * ) Notice: Subject to any disclaimer, the term of this patent is extended or adjusted under 35 U.S.C. 154(b) by 201 days.

(21) Appl. No.: 10/931,125

(22) Filed: Aug. 31, 2004

(65) Prior Publication Data

US 2006/0045994 A1 Mar. 2, 2006

(51) Int. Cl.
*A41G 1/00* (2006.01)

(52) U.S. Cl. ..... 428/17

(58) Field of Classification Search ..... 428/17
See application file for complete search history.

(56) References Cited

U.S. PATENT DOCUMENTS 3,602,938 A 9/1971 Lindsay
4,017,084 A 4/1977 Jeffery
4,474,833 A 10/1984 Maxfield
4,529,622 A 7/1985 Maxfield
5,258,222 A * 11/1993 Crivelli ..... 428/323
5,456,566 A 10/1995 Kniley et al.
5,472,743 A 12/1995 Daluise
5,885,168 A 3/1999 Bair
5,958,527 A 9/1999 Prévost
5,976,645 A 11/1999 Daluise
6,048,282 A 4/2000 Prévost
6,070,824 A 6/2000 DuPont
6,159,550 A 12/2000 Daluise
6,242,062 B1 6/2001 deVries
6,299,959 B1 10/2001 Squires
6,338,885 B1 1/2002 Prévost
6,372,310 B2 4/2002 deVries
6,432,505 B1 8/2002 Sweenie et al.
6,527,889 B1 3/2003 Paschal et al.
6,551,689 B1 4/2003 Prévost
6,689,447 B2 2/2004 Prévost
6,723,412 B2 4/2004 Prévost
6,818,274 B1 * 11/2004 Buck et al. ..... 428/87
2001/0033902 A1 * 10/2001 Seaton ..... 428/15
2002/0028307 A1 3/2002 Prévost
2002/0029515 A1 3/2002 Prévost
2002/0048676 A1 4/2002 McDaniel et al.
2002/0081399 A1 6/2002 Prévost
2002/0132099 A1 9/2002 Squires et al.
2002/0136846 A1 9/2002 Prévost
2003/0039511 A1 2/2003 Prévost
2003/0056432 A1 3/2003 Prévost
2003/0092531 A1 5/2003 Daluise
2003/0099787 A1 * 5/2003 Fink ..... 428/17
2003/0161996 A1 8/2003 Prévost
2003/0175448 A1 9/2003 Prévost
2004/0058096 A1 3/2004 Prévost
2004/0209038 A1 10/2004 Foxon
2006/0039754 A1 * 2/2006 Linville ..... 404/73

* cited by examiner

*Primary Examiner*—Jennifer C. McNeil
*Assistant Examiner*—Gordon R. Baldwin
(74) *Attorney, Agent, or Firm*—DLA Piper US LLP

(57) ABSTRACT

This invention relates to a synthetic turf comprised of a backing, a synthetic grass-like surface which is comprised of textured and non-textured grass-like fibers that are secured to the backing. The synthetic turf further comprises a fill layer comprised of substantially ambient rubber spread substantially uniform throughout the textured and non-textured grass-like fibers. This invention also relates to synthetic turf systems.

23 Claims, 2 Drawing Sheets

SYNTHETIC TURF SYSTEM AND METHOD

FIELD OF THE INVENTION

This invention relates to an improved synthetic surface. More particularly, the invention relates to an improved synthetic surface system that includes all of the requisite elements for installing a synthetic playing surface.

BACKGROUND OF THE INVENTION

For years natural turf surfaces were used for most outdoor sports: for example, soccer, football, field hockey, cricket, rugby, etc. Natural turf surfaces are surfaces constructed with a grass grown in soil, or some other surface layer of growth medium (e.g., sand and organic mixes, etc.), that is constructed upon a suitable foundation. A natural turf surface is generally preferred for its comfort, feel, grip, and appearance.

However, under heavy use and/or poor weather conditions, natural turf surfaces deteriorate rapidly and maintenance is costly. Intense activity on the turf destroys the grass and its root system, leaving mud and/or dirt on the playing surface. Prior to re-establishment of the turf, the surface is unsightly and often pockmarked, uneven, and possibly hazardous to use. Another problem associated with natural turf surfaces is the use of painted-on yardage and boundary lines. Typically, such boundary lines are formed by painting the playing surface. For aesthetic reasons, such lines are generally painted just prior to each official game played on the playing surface. The repeated application of paint to the surface of the playing surface tends to kill the grass that is located under the painted surface. In addition, over time the multiple layers of paint build up, forming a surface that is substantially harder than the surrounding natural grass playing surface.

Due to the needs of sports programs, even after destruction of portions of the turf, play usually continues on the playing surface, even when the surface is badly damaged, until the sport's season is over, when the turf can be re-established. Thus, the playing conditions on the playing surface continually decline over the season. At the end of the season, the natural turf surfaces are reseeded, the divots leveled and filled, etc. The natural turf surfaces are not usable during this re-establishment period. The re-establishment period typically takes at least four months, or longer, under ideal weather conditions, during which the natural turf surface should not be used.

Synthetic surfaces provide an alternative to natural turf surfaces. Synthetic surfaces generally come in three types, i.e., conventional, cryogenic rubber filled, and sand-filled or a combination of sand and cryogenic rubber. Conventional synthetic surfaces are a dense synthetic material that has the appearance of grass blades. Sand-filled and cryogenic rubber filled synthetic are synthetic materials that are similar to conventional synthetic turf, but with greater spacing between the blades, to accommodate a sand and/or cryogenic rubber filling.

Synthetic turf is installed with a carpet-like pile fabric having a flexible backing laid on a well drained compacted substrate, such as crushed stone or other stabilized base material. The pile fabric has rows of upstanding synthetic ribbons representing grass blades extending upwardly from the top surface of the backing.

Synthetic grass infill, for example, may comprise a mixture of 60% by weight of sand and 40% granulated cryogenic rubber particles uniformly mixed and deposited between the upstanding synthetic grass ribbons to a depth of 1 to 3 inches.

A high percentage of sand is preferred to minimize the cost of such systems, since cryogenic rubber particles are relatively expensive compared to sand. The sand particles also provide an improved degree of drainage that is needed where the synthetic grass surface is not in an enclosed stadium for example. Cryogenic rubber particles tend to impede the free flow of water, whereas the capillary action of the sand particles draws surface moisture downwardly due to the differences in surface tension characteristics between cryogenic rubber and silica sand.

Both the conventional and sand-filled synthetics are placed indoors or outdoors, upon a foundation that may include asphalt, concrete, wood, or other supporting subsurface along with cushioning mats, water drainage, and water irrigation. Although synthetic turf surfaces are more durable than well-established natural turf surfaces, they are only moderately successful for sports and other uses. The most notable disadvantages of synthetic turf surfaces are the discomfort for the players and an increased number of injuries. Yet, another concern with current synthetic grass systems is that there is a tendency of the filling (sand or cryogenic rubber) to compact over time. Thus, these surfaces are not satisfactory for many sports because the compaction of the top dressing limits the shock absorbing ability of the surface, and because "fill" top dressing is abrasive. Further, compacting of the fill eventually blocks the drainage holes of a synthetic turf system, thereby inhibiting proper drainage of moisture.

As can be seen from the above discussion, there exists a need for an improved surface for sports and other uses, and a method of making the improved surface, wherein the surface provides improved comfort and fewer injuries to the users, while being durable under heavy use and in poor weather conditions. The present invention is directed to fulfilling this need.

SUMMARY OF THE INVENTION

One aspect provides for a synthetic turf comprises of a primary backing and a second backing that has a synthetic grass like surface tufted thereto. The synthetic grass-like surface, in one embodiment, can be comprised of textured and non-textured grass-like fibers, where a dressing layer comprised of substantially ambient rubber acts as an infill between the fibers and is spread substantially uniform throughout the synthetic turf. In another aspect there is a synthetic turf system comprising the aforementioned elements and secured to a subsurface that is connected to a drainage system that is comprised of at least one drain pipe.

DETAILED DESCRIPTION

Figure 1:
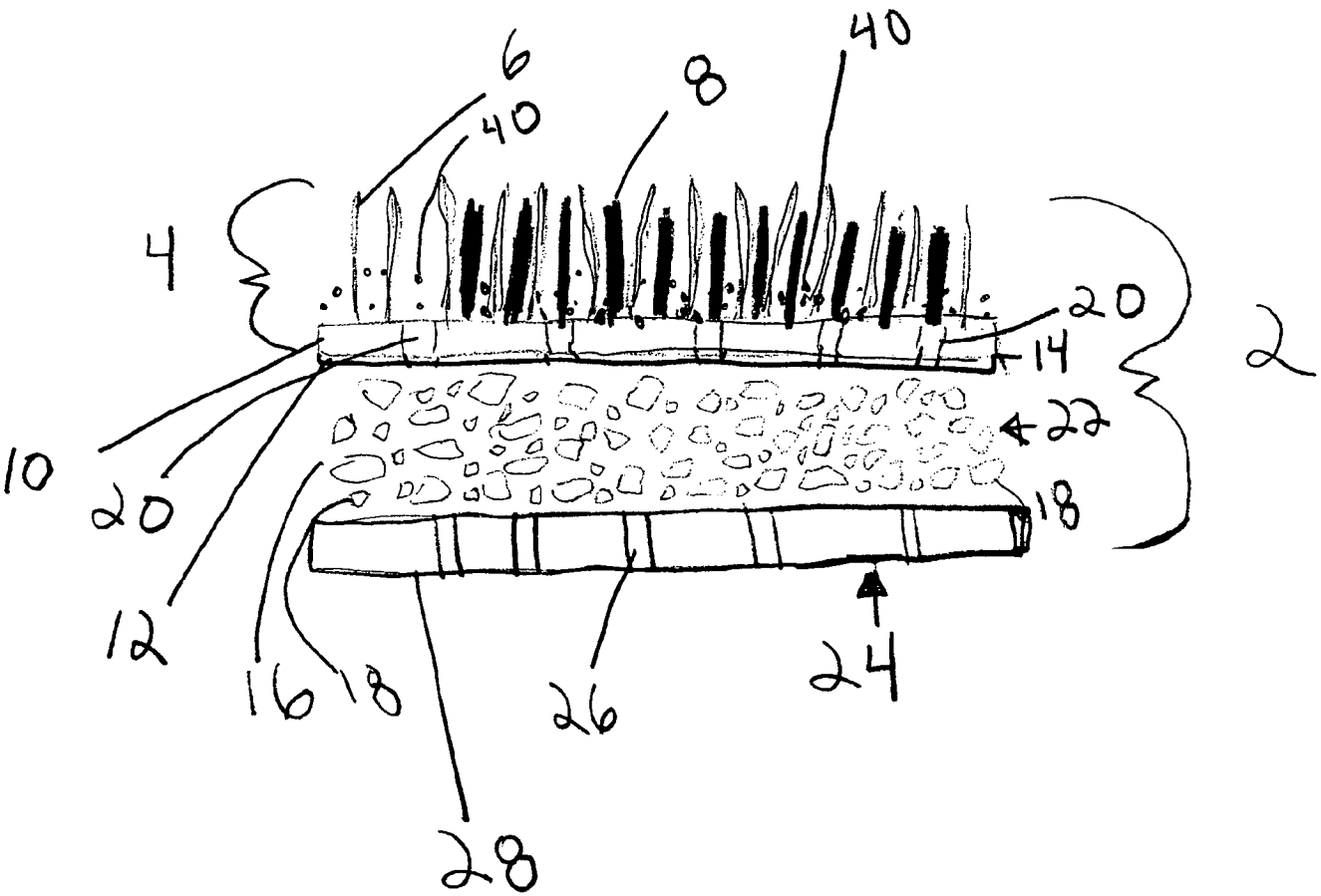
FIG. 1 shows a cross-sectional view of an exemplary synthetic turf system.

In accordance with an embodiment of the present invention, a synthetic turf incorporates individual synthetic blades of grass like fibers, tufted into a dimensionally stable backing system with polyurethane pre-coat that facilitates tuft-bind. In one aspect, the backing system is comprised of two separate backings, a primary backing and a secondary backing. The primary backing can have from 10-20 weaves/inch (Pic). The secondary backing can have from 8-17 weaves/inch (Pic). The secondary backing comprises impermeable, inert urethane compound that is applied to the underside of the primary backing. The primary backing weight can range from about 3 to 15 oz/Square yard. The secondary backing weight can range from about 5 to about 30 oz/Square yard. By underside it should be understood to mean the side of the primary backing that is closest to the core surface (e.g. the cement, compacted stone, asphalt etc.)

The synthetic grass of the present embodiment may be tufted into one or both of the backings to provide additional support for the individual synthetic grass blades. In one aspect, the tuft bind is 21-pounds/Square inch. In other words, 21 pounds of force must be applied to a square inch of synthetic grass surface in order to remove the tufted grass from the backing system. The synthetic grass is then filled with a dressing layer comprised of cuboidal ambient rubber infill. Generally, the infill measures from 0.5 to 1.5 mm in diameter. The texturized fiber of the synthetic grass curls down to cover and trap the ambient rubber granules helping to prevent the system from expelling the infill upon impact from such sources as players feet or balls.

The length of the synthetic turf yam may be selected to be an appropriate value, from 0.5 to 4 inches, depending on applications. In one aspect, the synthetic turf yam is about $2^{1/4}$ inches. In one particular aspect, the synthetic turf has two face yams, one of which is non-textured, and one of which is textured. Such textured yams include melamin/phenol/formaldehyde molding compounds (MPF), a low density, rigid polyurethane textured material, which provides a curled yam that helps provide a grip for the surface. One exemplary non-textured pile yam is a Teflon coated (TtC) polyethylene. The synthetic turf may be preferably knitted, and the non-textured face yam or pile has a pile height exceeding about 0.5 inch, preferably having a height of at least about 1.0 inch. In use, the textured pile has a height significantly lower than the pile height of the non-textured pile, preferably a pile height of at least 25% less than the pile height of the non-textured pile. The textured and non-textured pile yams may be knotted together with a stitch-in yam, to form rows of knots in the machine direction of the synthetic turf as it is being manufactured, and lay-in yarns are interlocked with the rows of knots to form a base for the pile yarns. A seal may be applied to the backing for additional dimensional stability. In yet another aspect, the tufting gauge, which is the distance between stitch rows, is between about ¼ inch to about ¾ inch. In one particular aspect, the tufting gauge is about ½ inch.

The pile weight describes the amount of fiber weight per square yard. In general, the higher the pile weight, the more fibers that result, and the more fiber, the better the quality of the system. In use, denser fibers fold over the ambient rubber granules to retain the rubber granules in place and prevent them from migrating over the field. Thus, in one aspect, the pile weight is at least 50 oz/Square yard, and more preferably, at least 55 oz/Square yard.

In another aspect, the synthetic turf according to an embodiment of the present invention is made using a knitting process. The synthetic turf is preferably mounted on a subsurface, and preferably the subsurface includes one or more of concrete or asphalt pavement, compacted clay, gravel, and gravel mixed with soil, and then more soil or a foamed product may be laid on the subsurface. A fill material, preferably particles comprised substantially of ambient rubber, is placed in and around the textured and non-textured pile, preferably to about the height of the textured pile. Any other types of fill may be utilized as well, such as other types of rubber and/or sand, as examples.

The synthetic grass in accordance with an embodiment of the invention is maintenance-free, provides a uniform surface, and has substantial give underfoot. Further, the synthetic grass in accordance with embodiments of the invention can be used in all weather conditions. The synthetic grass is preferably UV stabilized and can be installed overtop of a variety of surfaces including, asphalt, concrete, or compacted stone. In one preferred aspect, the turf is installed overtop layers of compressed stone of different sizes, wherein a drainage system is installed underneath of the compressed stone. In one aspect, the backing of the synthetic turf is secured by an adhesive, preferably glue, to the compressed stone.

Denier is defined as the number of grams in a 9,000 meter yarn strand. Essentially denier tells one how much material goes into the manufacture of a strand of fiber or one blade. The higher the denier the more dense the fibers. More density means better quality and longevity. The thickness and denier number of the synthetic grass filament used may be appropriately selected within a range suitable for a given application of the synthetic turf. However, when the synthetic turf yarn is too thin, it lacks durability, and when too thick, it differs from natural grass in appearance and feel. Therefore, in one embodiment, the synthetic turf yarn is preferably in the range of 5 to 15,000 denier. In one aspect, the denier is at least 10,000 denier.

In another aspect, the synthetic turf system includes drainage holes in the primary and secondary backing. These drainage holes can be scattered throughout the primary and secondary backing system. In one preferred aspect, the drainage holes allow the passage of moisture and other sediments to pass through the synthetic turf and backing system and into the compressed surface underneath. In one aspect, the drainage holes provide perforations, which are about 1 inch to about 3 inches in diameter. In one particularly preferred aspect, the drainage holes are between 2 and 2⅛ inches. The moisture then passes through the compressed surface and into the drainage system, so as to remove the moisture from the playing area.

FIG. 1. shows a cross-sectional view of an exemplary synthetic turf system (2) for use as a playing surface. In particular, it shows a synthetic turf (4) that is comprised of non-textured synthetic fibers (6) and textured synthetic fibers (8) that are woven into a primary backing (10), which is in contact with a secondary backing (12). The textured and non-textured synthetic fibers behave as if they were individual blades of grass. The secondary backing has an adhesive, preferably, a polyurethane glue (14) on its underside, that facilitates the binding of the synthetic turf (4) to a surface, preferably comprised of compressed stone (16). In this embodiment, the surface is formed by multiple layers of compressed stone of differing sizes (18). Furthermore the primary backing (10) and secondary backing (12) have apertures (20) through which moisture can pass to the compressed stone (16). The apertures (20) are generally annular in configuration and are spread throughout the primary backing (10) and secondary backing (12). Of course, there can be any of a number of apertures (20), and the size, shape and location can vary depending on the individual conditions for each installment of the synthetic turf system.

The compressed stone in this embodiment (16) is in layers (22) that help to facilitate the flow of moisture from the synthetic turf (4) to a drainage system (24). The drainage system in this embodiment is comprised of one or more, and preferably an arrangement of drain pipes (28) that receive moisture passing through the apertures in the turf and the compressed stone. The pipes include at least one, and preferably, a plurality of apertures through its outer surface into which the moisture passing through the turf and compresses stone is received. The pipes carry the moisture to a designated location to dispose of the liquid, such as a public sewer. In other embodiments, other suitable types of drainage systems may also be used.

Further, the synthetic turf has a fill, preferably ambient rubber particles (40), displaced generally evenly between the fibers (8 and 6). This can be accomplished, for example, by using a conventional seed spreader to lay the ambient rubber particles, and then raked by hand or using a tractor to generally evenly displace the material. These ambient rubber particles (40) provide a cushion as well as a "natural like" feel and appearance.

Figure 2:
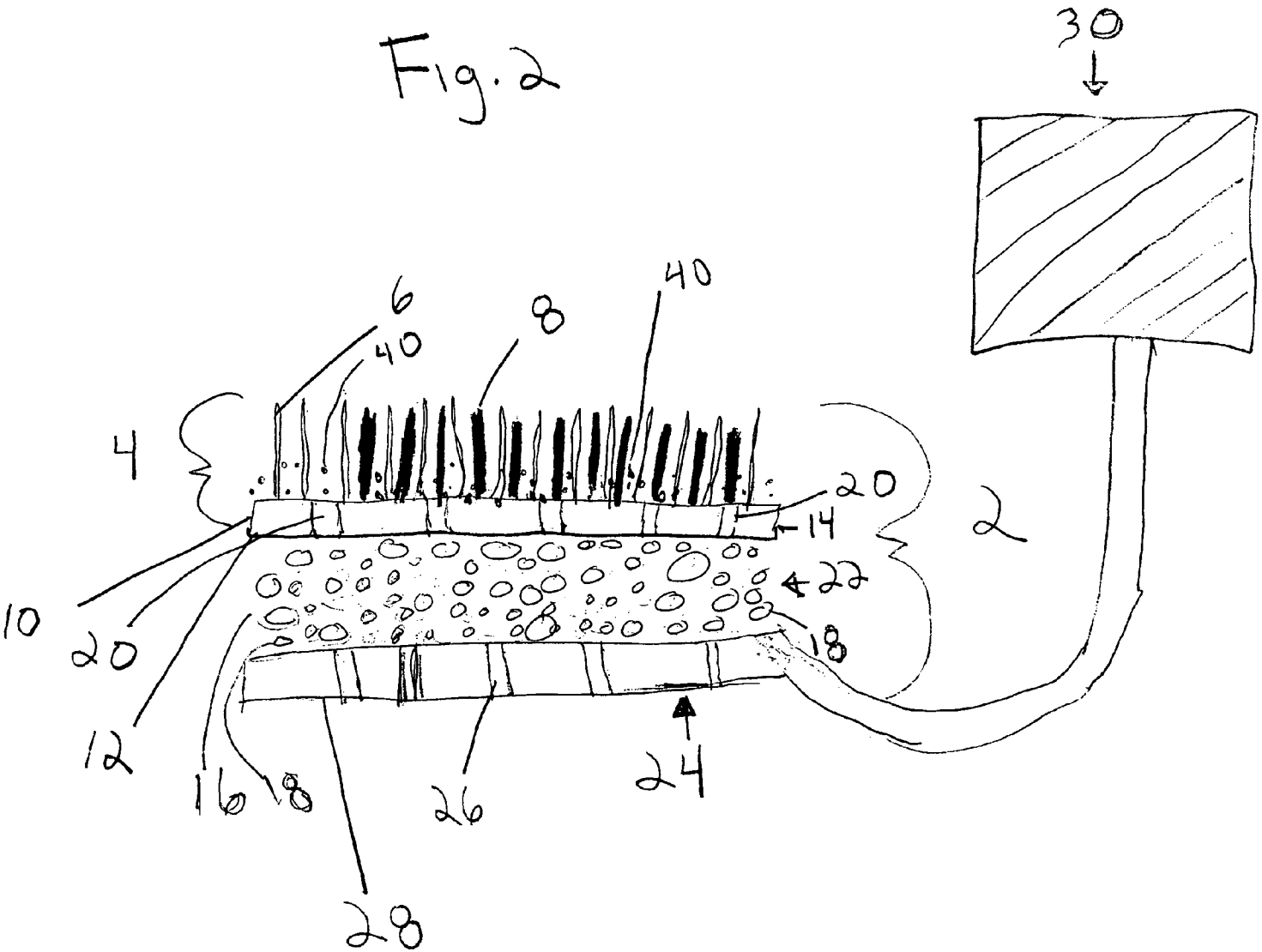
FIG. 2 shows a cross-sectional view of an exemplary synthetic turf system optionally connected to a vacuum system.

FIG. 2 shows a suction system (30) that is optionally included as part of the drainage system (24) and applies a suction pressure through the apertures (26) in the drain pipe (28) to assist in pulling moisture from the synthetic turf (4) to the drain pipe (28).

For purposes of illustration, the following sets forth physical characteristics of the various components of an exemplary embodiment of a synthetic turf system. This example is for explanatory purposes only, and in no way limits the scope of this invention.

| Physical Characteristics | |
|---|---|
| 1. Yarn | TtC Polyethylene/MPF Texturized |
| 2. Pile Weight | 55 oz/Sq. Yd. |
| 3. Primary Backing Weight | 8 oz./Sq. Yd. |
| 4. Secondary Backing Weight | 20 oz./Sq. Yd. |
| 5. Foam Backing Weight | N/A |
| 6. Total Weight | 83 oz./Sq. Yd. |
| 7. Yarn I Denier | 10000 Dtex PE (denier) |
| 8. Yarn II Denier | 6/7500 MPF Texturized |
| 9. Pile Height | 2 ¼" or 57 mm +/− 2 mm |
| 10. Tufting Gauge | ½ |
| 11. Primary Backing 1 | 15 Pic Polyback (weaves/inch) |
| 12. Primary Backing 2 | 13 Pic Polyback (weaves/inch) |
| 13. Widths | 12' or 15' |
| 14. Perforation | 2" × 2 ⅛" |

The yarn is tufted through the primary and secondary backing system to provide a tuft bind of 21 lbs/Square inch. Of course, a foam backing can also be employed as desired.

The ambient rubber used for the infill is comprised of material having the following weight percentages:

| | Min | Max |
|---|---|---|
| Acetone Extract | 8.0 wt % | 22.0 wt % |
| Ash | 0.0 wt % | 8.0 wt % |
| Carbon Black | 26.0 wt % | 38.0 wt % |
| Natural Rubber | 10.0 wt % | 35.0 wt % |
| Rubber Hydrocarbon | 42.0 wt % | 56.0 wt % |
| Moisture | 0.0 wt % | 1.0 wt % |
| Free Fabric | 0.0 wt % | .05 wt % |

The ambient rubber is granular and cubodial and has a diameter of 0.5 to 1.5 mm. The ambient rubber described above when used as infill provides superior shock absorption, facilitates clearance of moisture, and allows for superior grip. This ambient rubber may be spread by a seeding machine to evenly distribute the rubber throughout the synthetic turf. The ambient rubber particles rest in the bottom portion of the synthetic turf blades, but do not become compacted upon compression. This facilitates the passage of moisture, since the rubber particles do not block the drainage holes in the synthetic turf backing system.

The synthetic turf is installed overtop of compacted stone of varying diameters. Underneath of the compacted stone is a drainage system that facilitates removal of water from the playing surface. The drainage system comprises an arrangement of pipes to carry the water to a location to dispose of the water, such as into the public sewer system. The drainage system can optionally include a pressurization system, which facilitates the gravitational flow of moisture into the drainage system, by applying a suction pressure through the apertures of the drainage pipes within the drainage system.

The foregoing embodiments are especially suited for soccer, but can be utilized for any desired purpose, such as any sport activity, such as football, baseball, field hockey, as examples, or used just for landscape, such as at any commercial or residential location, a park or playground, to name a few.

The above description and the views and material depicted by the figures are for the purpose of illustration only and are not intended to be, and should not be construed as, limitations on the invention.

Moreover, certain modifications or alterations may suggest themselves to those skilled in the art upon reading of this specification, all of which are intended to be within the spirit and scope of the present invention as defined in the attached claims.

The invention claimed is:

1. A synthetic turf comprising:

(a) a primary backing having about 15 weaves/inch (Pic), a weight of about 8 oz/square yard, and apertures of about 2 to 3 inches in diameter;

(b) a secondary backing having about 13 weaves/inch (Pic), a weight of about 20 oz/square yard, and apertures of about 2 to 3 inches in diameter, and wherein said primary and secondary backing are cut into about 12 to 15 feet widths;

(c) a synthetic grass like surface comprised of textured and non-textured grass-like fibers, wherein the textured grass like fibers are comprised of melamin/phenol/formaldehyde molding compounds (MPF) having a denier of between 6 and 7500 denier and wherein the non-textured grass-like fibers are comprised of Teflon coated (TtC) polyethylene having a denier of about 10,000 and wherein said textured and non-textured grass-like fibers have a pile weight of about 55 oz/Square yard and a pile height of between 2 to 3 inches; and (d) a fill layer comprised of substantially ambient rubber and spread substantially uniform throughout said textured and non-textured grass-like fibers, wherein said ambient rubber comprises:

(i) acetone extract in a range of about 8 wt % to about 22 wt %;

(ii) ash in a range of about 0 wt % to about 8 wt %;

(iii) carbon black in a range of about 26 wt % to about 38 wt %

(iv) natural rubber in a range of about 10 wt % to about 35 wt %;

(v) rubber hydrocarbon in range of about 42 wt % to about 56 wt %; and wherein the remainder comprises moisture.

2. The synthetic turf of claim 1, wherein the primary backing is treated with a polyurethane pre-coat.

3. The synthetic turf of claim 1, wherein the secondary backing further comprises impermeable inert urethane a polyurethane adhesive coating on an underside thereof, for facilitating adhesion of the synthetic turf to a supporting surface.

4. The synthetic turf of claim 1, wherein the textured grass-like fiber and the non-textured grass-like fiber are yarn.

5. The synthetic turf of claim 1, wherein said textured grass-like fibers have a pile height at least 25% less than the pile height of the non-textured pile.

6. The synthetic turf of claim 1, wherein said textured grass-like fibers are tufted into said primary and secondary backings and have a tuft bind to said primary and secondary backing of 21 lbs/Square inch.

7. The synthetic turf of claim 1, having a tufting gauge of between 0.25 and 0.75.

8. A synthetic turf comprising:

(a) a primary backing having apertures;

(b) a secondary backing having apertures and wherein said primary and secondary backing are cut into widths;

(c) a synthetic grass like surface comprised of textured and non-textured grass-like fibers; and (d) a fill layer comprised of substantially rubber and spread substantially uniform throughout said textured and non-textured grass-like fibers, wherein said ambient rubber comprises:

(i) acetone extract in a range of about 8 wt % to about 22 wt %;

(ii) ash in a range of about 0 wt % to about 8 wt %;

(iii) carbon black in a range of about 26 wt % to about 38 wt %

(iv) natural rubber in a range of about 10 wt % to about 35 wt %;

(v) rubber hydrocarbon in range of about 42 wt % to about 56 wt %; and wherein the remainder comprises moisture.

9. The synthetic turf of claim 8, wherein said primary backing has a weight of about 3 to about 15 oz/Square yard.

10. The synthetic turf of claim 8, wherein said secondary backing weight has a weight of about 5 to about 30 oz/Square yard.

11. The synthetic turf of claim 8, wherein the yam is comprised of melamin/phenol/formaldehyde molding compounds (MPF).

12. The synthetic turf of claim 8, wherein the non-textured grass-like fiber is a yarn coated with Teflon (TtC) polyethylene.

13. The synthetic turf of claim 8, wherein said synthetic grass-like surface has a pile weight of at least 50 oz/Square yard.

14. The synthetic turf of claim 8, wherein said synthetic grass-like surface has a has a pile height exceeding about from 0.5 to about 4.0 inches.

15. The synthetic turf of claim 8, wherein said textured and non-texture rass-like fibers have a denier of between about 5 to 15,000 denier.

16. The synthetic turf of claim 8, wherein said primary and said secondary backing have apertures of about 1 to 3 inches in diameter.

17. The synthetic turf of claim 8, wherein the primary backing is treated with a polyurethane pre-coat.

18. The synthetic turf of claim 8, wherein the secondary backing comprises impermeable inert urethane and a polyurethane adhesive coating on an underside thereof, for facilitating adhesion of the synthetic turf to a supporting surface.

19. The synthetic turf of claim 8, wherein the textured grass-like fiber and the non-textured grass-like fiber are yarn.

20. The synthetic turf of claim 8, wherein said textured grass-like fibers have a pile height at least 25% less than the pile height of the non-textured pile.

21. The synthetic turf of claim 8, wherein said textured grass-like fibers are tufted into said primary and secondary backings with a tuft bind to said primary and secondary backing of 21 lbs/Square inch.

22. The synthetic turf of claim 8, having a tufting gauge of between 0.25 and 0.75.

23. A fill layer for a synthetic turf having a primary backing with apertures and wherein said primary backing is cut into widths and synthetic grass-like surface fibers, the fill layer comprising substantially ampient rubber spreadable in a substantially uniform manner throughout said grass-like fibers, wherein said ambient rubber comprises:

(i) acetone extract in a range of about 8 wt % to about 22 wt %;

(ii) ash in a range of about 0 wt % to about 8 wt %;

(iii) carbon black in a range of about 26 wt % to about 38 wt %

(iv) natural rubber in a range of about 10 wt % to about 35 wt %;

(v) rubber hydrocarbon in range of about 42 wt % to about 56 wt %; and wherein the remainder comprises moisture.

* * * * *